US009427613B2

(12) United States Patent
Jordan et al.

(10) Patent No.: US 9,427,613 B2
(45) Date of Patent: Aug. 30, 2016

(54) JUMP ROPE HANDLE WITH MULTIPLE BEARINGS

(71) Applicant: Ultra Speed Ropes Inc., Leavenworth, WA (US)

(72) Inventors: Jeff B. Jordan, Baton Rouge, LA (US); Matthew Thomas Hopkins, Leavenworth, WA (US)

(73) Assignee: Ultra Speed Ropes Inc., Leavenworth, WA (US)

( * ) Notice: Subject to any disclaimer, the term of this patent is extended or adjusted under 35 U.S.C. 154(b) by 78 days.

(21) Appl. No.: 14/285,464

(22) Filed: May 22, 2014

(65) Prior Publication Data

US 2015/0335931 A1 Nov. 26, 2015

(51) Int. Cl.

| | |
|---|---|
| ***A63B 21/00*** | (2006.01) |
| ***A63B 5/20*** | (2006.01) |
| ***A63B 21/06*** | (2006.01) |

(52) U.S. Cl.
CPC ..... *A63B 5/20* (2013.01); *A63B 21/06* (2013.01); *A63B 21/4035* (2015.10)

(58) Field of Classification Search
CPC ..... A63B 21/00
USPC ..... 482/81, 82
See application file for complete search history.

(56) References Cited

U.S. PATENT DOCUMENTS

| | | | | |
|---|---|---|---|---|
| 5,054,772 | A * | 10/1991 | Winston | 482/82 |
| 5,697,871 | A * | 12/1997 | Landfair | 482/82 |
| 6,551,222 | B1 * | 4/2003 | Beaver | 482/82 |
| 7,086,951 | B2 * | 8/2006 | Chang | 463/47.5 |

* cited by examiner

*Primary Examiner* — Jerome w Donnelly
(74) *Attorney, Agent, or Firm* — Blakely Sokoloff Taylor & Zafman LLP

(57) ABSTRACT

Jump rope handles are disclosed. In an embodiment, a speed rope includes a jump rope handle having a plurality of bearings rotationally coupling a handle head with a handle grip. In an embodiment, the handle head includes a rope landing axially between the plurality of bearings.

15 Claims, 11 Drawing Sheets

A - A

DETAIL A

JUMP ROPE HANDLE WITH MULTIPLE BEARINGS

BACKGROUND

1. Field

The present invention relates to jump rope handles. More particularly, embodiments of the present invention relate to jump rope handles having a plurality of bearings rotationally coupling a handle head with a handle grip.

2. Background Information

Jump ropes are exercise equipment used for play, exercise, training, and sport. Referring to FIG. 1, a pictorial view of a jumper using a jump rope is shown. A typical jump rope includes a rope 100 with a handle 102 at either end for a jumper 104 to grip and control the swinging of the rope. In the sport of speed rope skipping, a jumper may try to complete as many jumps as possible within a particular amount of time. For example, the jumper could complete as many as one hundred jumps during a thirty second interval. To achieve this intensity of jumping, a specialized jump rope, sometimes referred to as a speed rope, may be required.

Referring to FIG. 2, a cross-sectional view of a portion of a jump rope handle is shown. A typical speed rope handle 102 may include a handgrip 202 for a jumper to hold and a nut 204 fixed to rope 100. Nut 204 may rotate relative to handgrip 202 such that the entire rope 100 swings about a handle axis. This differs from conventional jump rope handles in which a portion of rope 100 remains fixed relative to handgrip 202 and a portion of rope 100 swings about the handle axis such that a region of localized cyclic bending stresses occurs in rope 100 between the portions. By rotationally decoupling rope 100 from handgrip 202 as shown in FIG. 2, rope speed and control may be improved to facilitate faster jumping.

In a typical speed rope, nut 204 is fixed to a screw 206 that passes through a retaining element engaged with handgrip 202, e.g., screw 206 may extend through a bushing 212 pressed into an end of handgrip 202. Nut 204 may be threaded onto a threaded portion 208 of screw 206 to retain a screw shank 210 within bushing 212, allowing shank 210 and nut 204 to rotate freely relative to handgrip 202. However, during use, as rope 100 swings quickly around the jumper, transverse loading in a radial direction may be applied to the threaded portion 208 of screw 206 by rope 100, and therefore, the cantilevered screw 206 may transmit both transverse and axial loads, as well as substantial torque, to bushing 212. More particularly, the cantilever load placed on screw 206 by rope 100 may result in loading, and thus, friction between screw 206 and bushing 212. This friction may reduce an achievable jumping speed. Furthermore, axial and torsional loading of bushing 212 can result in material stresses that bushing 212 is not designed to withstand, which may lead to failure of bushing 212. Thus, conventional speed ropes may not be durable and/or may prevent a jumper from reaching their performance goal.

SUMMARY OF THE DESCRIPTION

A jump rope handle is disclosed. In an embodiment, a jump rope handle includes a grip having a shaft, and a head rotationally coupled with the grip by a plurality of bearings. Each of the plurality of bearings may include a bearing inner surface adjacent to the shaft and a bearing outer surface adjacent to the head. Furthermore, the head may include a rope landing intermediate to the plurality of bearings. For example, the rope landing may be axially centered between the plurality of bearings. Thus, transverse loading on the head that occurs, for example, during speed rope skipping, may be equally or nearly equally shared between the plurality of bearings.

In an embodiment, the plurality of bearings include a distal bearing and a proximal bearing that are each selected from a group consisting of a plain bearing, a rolling bearing, a fluid bearing, and a magnetic bearing. For example, at least one of the distal bearing or the proximal bearing may include a rolling bearing having an inner race coupled with the shaft at the bearing inner surface and an outer race coupled with the head at the bearing outer surface. Furthermore, the rolling bearing may include a thrust bearing to support axial loading of the bearing system. For example, the proximal bearing may be a thrust bearing. Alternatively or additionally, at least one of the distal bearing or the proximal bearing may include a plain bearing having the bearing outer surface and the bearing inner surface.

In an embodiment, the shaft is integral with the grip. For example, the shaft may include a threaded base configured to be threaded into the grip. Alternatively, the shaft may include a boss configured to be pressed into the grip. Furthermore, in an embodiment, the grip includes a foot having a foot outer surface tapering inward in a distal direction.

In an embodiment, a speed rope includes a handle having a grip that includes a shaft, a head rotationally coupled with the grip by a plurality of bearings, and a rope landing. Each of the plurality of bearings may include a bearing inner surface adjacent to the shaft and a bearing outer surface adjacent to the head. The speed rope may include a rope having a first end opposite of the rope landing from a second end, and a rope retainer may be coupled with the rope opposite of the rope landing from the second end to secure the rope in the head.

In an embodiment, the rope landing of the speed rope is intermediate to the plurality of bearings. For example, the rope landing may be axially centered between the plurality of bearings. Thus, transverse loading on the head that occurs, for example, during use of the speed rope, may be equally or nearly equally shared between the plurality of bearings.

In an embodiment, the plurality of bearings include a distal bearing and a proximal bearing selected from a group consisting of a plain bearing, a rolling bearing, a fluid bearing, and a magnetic bearing. For example, at least one of the distal bearing or the proximal bearing of the speed rope may include a rolling bearing having an inner race coupled with the shaft at the bearing inner surface and an outer race coupled with the head at the bearing outer surface.

DETAILED DESCRIPTION

Figure 1:
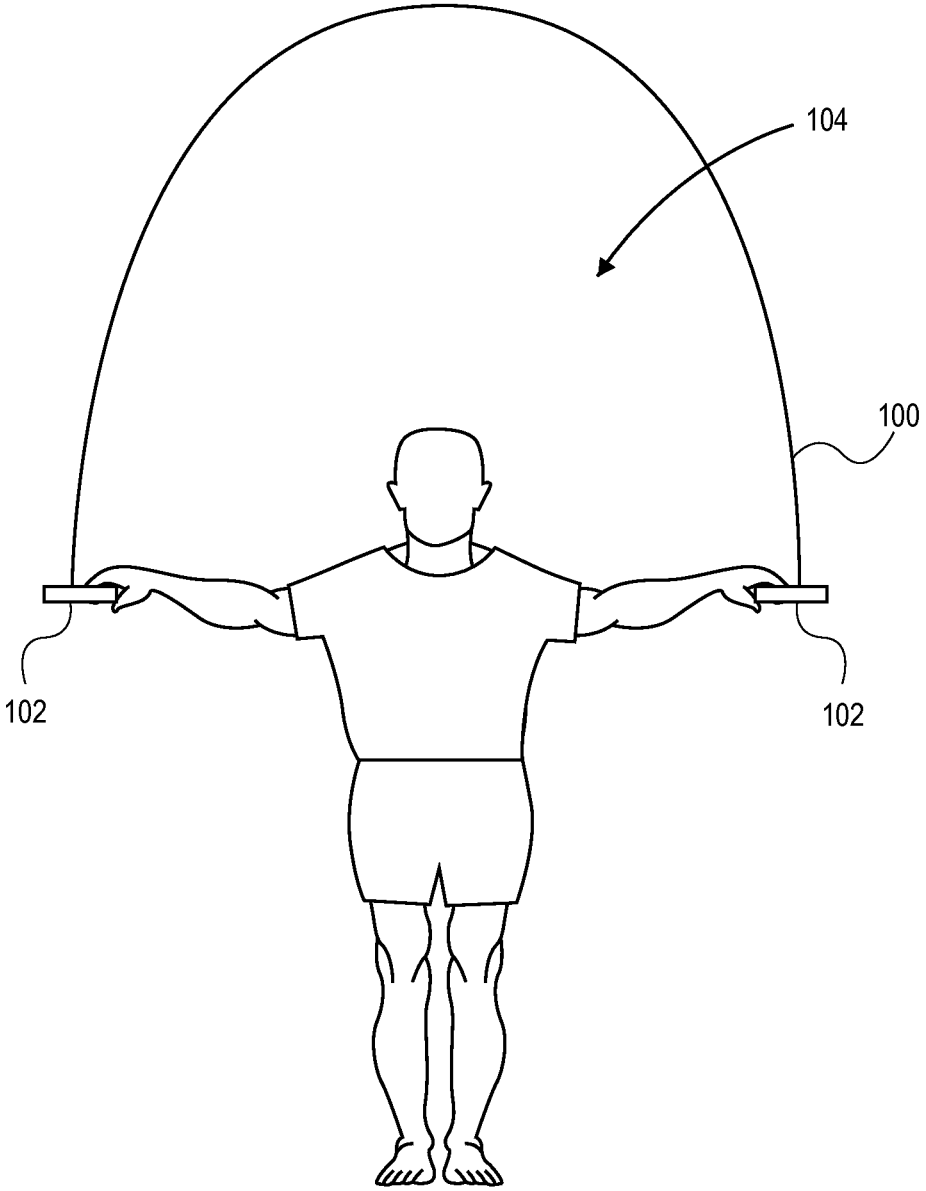
FIG. 1 is a pictorial view of a jumper using a jump rope.

Embodiments of the present invention describe jump rope handles. While some embodiments of the present invention are described with specific regard to speed rope training, the embodiments of the invention are not so limited and certain embodiments may also be applicable to other activities, such as jump rope skipping.

In various embodiments, description is made with reference to the figures. However, certain embodiments may be practiced without one or more of these specific details, or in combination with other known methods and configurations. In the following description, numerous specific details are set forth, such as specific configurations and processes, in order to provide a thorough understanding of the present invention. In other instances, well-known processes and manufacturing techniques have not been described in particular detail in order to not unnecessarily obscure the present invention. Reference throughout this specification to "one embodiment," "an embodiment", or the like, means that a particular feature, structure, configuration, or characteristic described in connection with the embodiment is included in at least one embodiment of the invention. Thus, the appearances of the phrase "one embodiment," "an embodiment", or the like, in various places throughout this specification are not necessarily referring to the same embodiment of the invention. Furthermore, the particular features, structures, configurations, or characteristics may be combined in any suitable manner in one or more embodiments.

In an aspect, embodiments describe a jump rope handle having a plurality of bearings rotationally coupling a head with a grip. In an embodiment, the plurality of bearings include one or more rotating bearings having an inner race coupled with the grip and an outer race coupled with the head. The rotating bearings may support the head at either end on the grip such that the head is only in contact with the outer race of the bearings. Furthermore, in an embodiment, an inner race of each bearing is only in contact with a shaft integral with the grip. Thus, a rotating mass of the handle and friction between handle components may be decreased to improve rope rotation speed.

In another aspect, embodiments describe a jump rope handle having a rope landing intermediate to a plurality of bearings that rotationally couple a head with a grip. More particularly, a rope may be secured to the head axially between a distal bearing and a proximal bearing. Accordingly, as the head rotates around the grip during use, the rope may apply a transverse load in a radial direction at the rope landing intermediate to the bearings. In an embodiment, since the rope is secured between the bearings, e.g., at an axially centered location between the bearings, the transverse load may be shared equally by the bearings and/or transverse loading on the bearings may be in a same direction. Furthermore, axial loading of the bearings due to an axial load component of the rope during use may be shared by both bearings. By distributing loading equally on the bearings, maximum loading applied to any one of the bearings may be reduced, and thus, the life of the bearing system may be extended.

Figure 3:
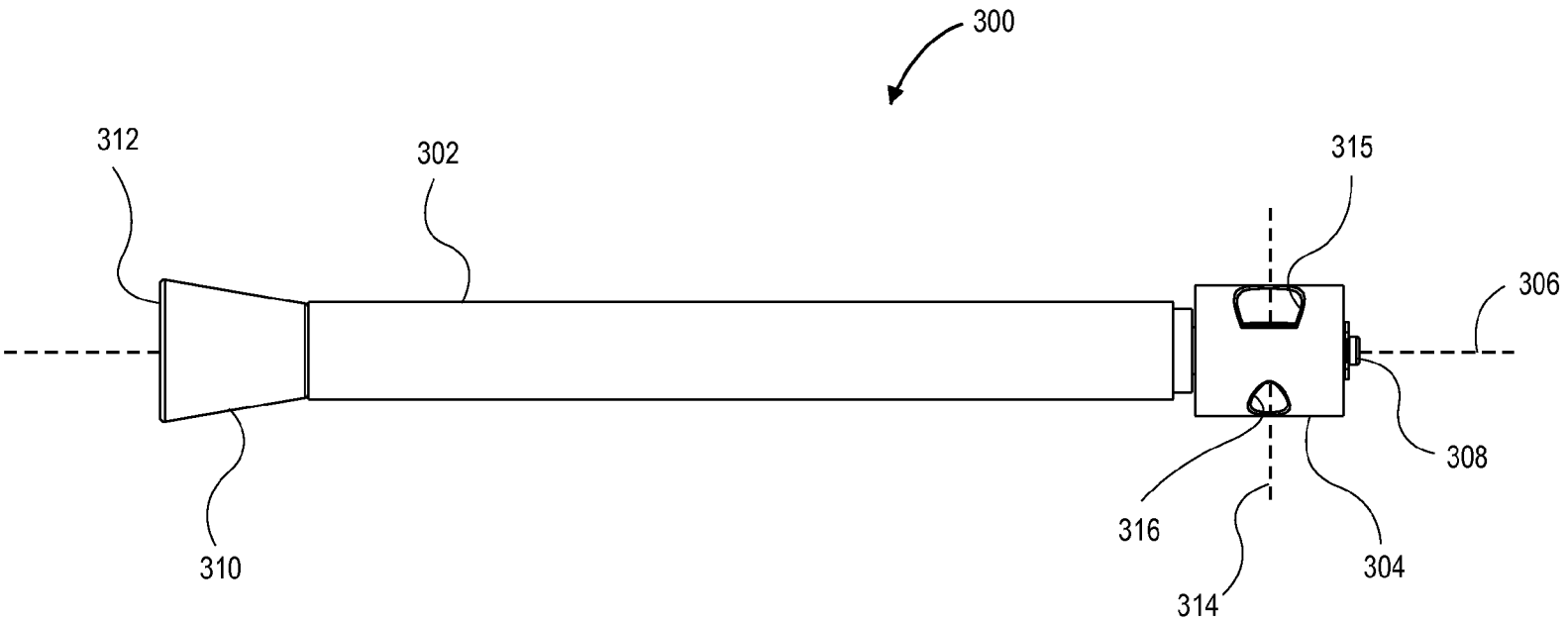
FIG. 3 is a top view of a jump rope handle in accordance with an embodiment.

Referring to FIG. 3, a top view of a jump rope handle is shown in accordance with an embodiment. A handle 300 may be a jump rope handle and or may be particularly well-suited for speed rope jumping. That is, handle 300 may be a speed rope handle designed for high intensity jump roping. Accordingly, handle 300 may include a grip 302 and a head 304 coaxially aligned along a central axis 306. Head 304 may be located near a distal end 308 of handle 300 and a foot 310 may be located at a proximal end 312 of handle 300, opposite from distal end 308. During use, a jumper may hold grip 302 to control rotation of head 304 about central axis 306. More particularly, head 304 may include features to secure a rope relative to head 304 along a rope path 314, and thus, a jumper may control rotation of the head 304 relative to grip 302, and swinging of the rope about central axis 306, by manipulating grip 302.

In an embodiment, a rope may pass through head 304 along a rope path 314 that is transverse to central axis 306. For example, rope path 314 may follow a hole drilled or otherwise bored through head 304. The hole may be radially offset from central axis 306. Thus, the hole may have an entry port forming a rope landing 315 through which the rope may be inserted and passed along rope path 314. The rope may exit head 304 at a rope retainer slot 316, which may form a second opening of the hole. After passing the rope through the hole, the rope may be secured relative to head 304. For example, a knot may be tied at an end of the rope and/or a rope fastener may be affixed to the rope such that the knot or the rope fastener resist movement through the hole at rope retainer slot 316. In an embodiment, as the rope swings about a jumper, the rope may apply a radial load at rope landing 315, producing a transverse load on head 304. Rope landing 315 may include a wider opening than rope retainer slot 316 to provide a strain relief for the rope that allows the rope to bend at rope landing 315 without being abraded by head 304. In an embodiment, edges of rope landing 315 and rope retainer slot 316 may be deburred, chamfered, or otherwise softened to further mitigate the risk of abrading the rope through extended use.

Figure 4:
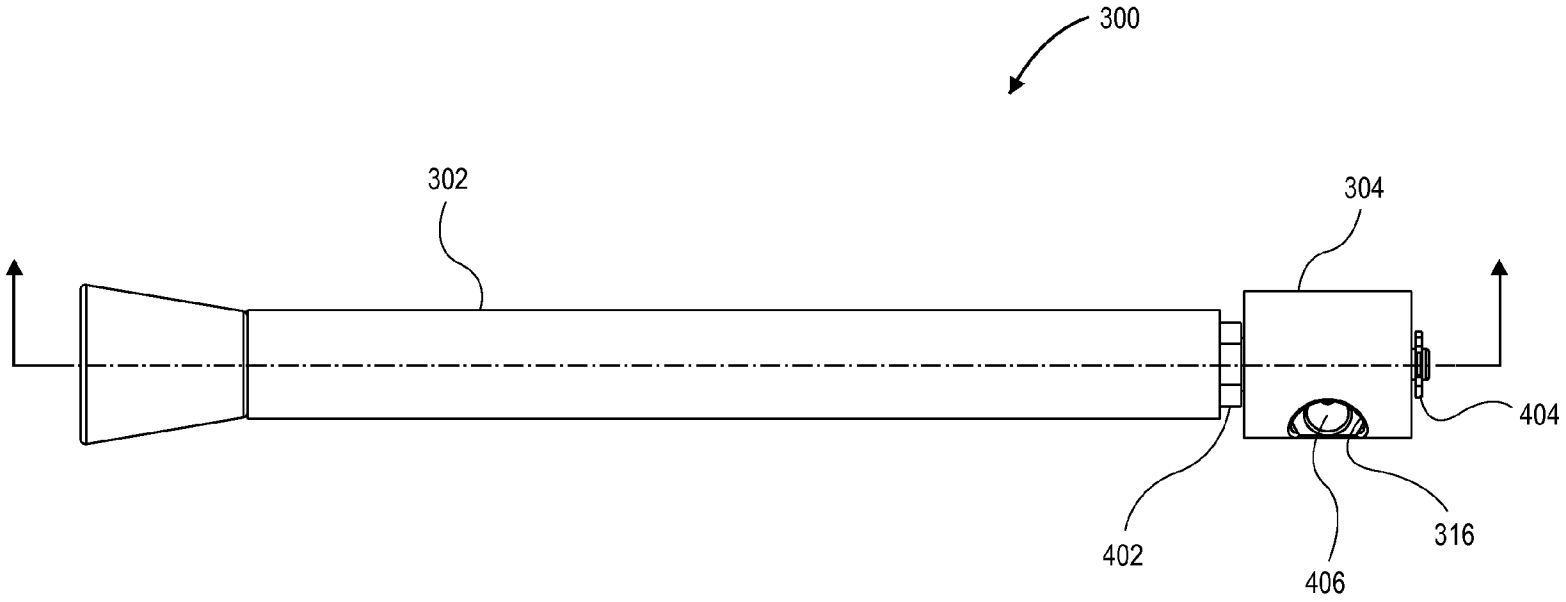
FIG. 4 is a side view of a jump rope handle in accordance with an embodiment.

Referring to FIG. 4, a side view of a jump rope handle is shown in accordance with an embodiment. Handle 300 is shown in an assembled state with head 304 axially aligned with grip 302. More particularly, head 304 may be spaced apart from grip 302 by a shoulder 402 but retained adjacent to grip 302 by a retaining clip 404. Furthermore, head 304 may include a rope guide 406 passing through a hole in head 304 along rope path 314. Rope guide 406 may be radially offset from central axis 306. Thus, a rope may pass through rope guide 406 and be secured by a rope fastener set within rope retainer slot 316, as described above.

Figure 5:
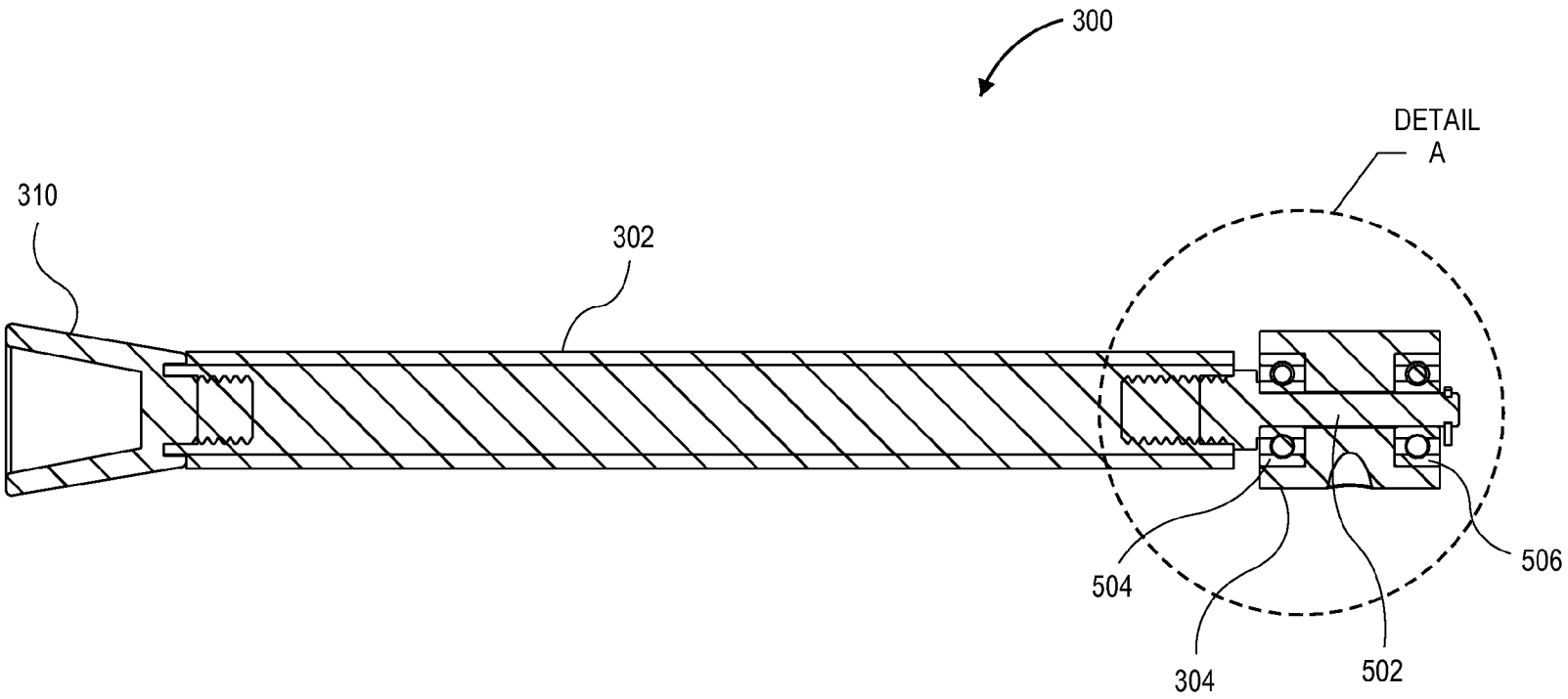
FIG. 5 is a cross-sectional view, taken about line A-A of FIG. 4, of a jump rope handle in accordance with an embodiment.

Referring to FIG. 5, a cross-sectional view of a jump rope handle, taken about line A-A of FIG. 4, is shown in accordance with an embodiment. Handle 300 may include grip 302, foot 310, and a shaft 502 arranged longitudinally about central axis 306. In an embodiment, head 304 is rotationally supported on shaft 502 by a plurality of bearings, such as a proximal bearing 504 and a distal bearing 506. More particularly, head 304 may be rotationally decoupled from shaft 502 by the bearings such that a torque applied to head 304, for example, by momentum of a swinging rope, is not transmitted to shaft 502.

Figure 6:
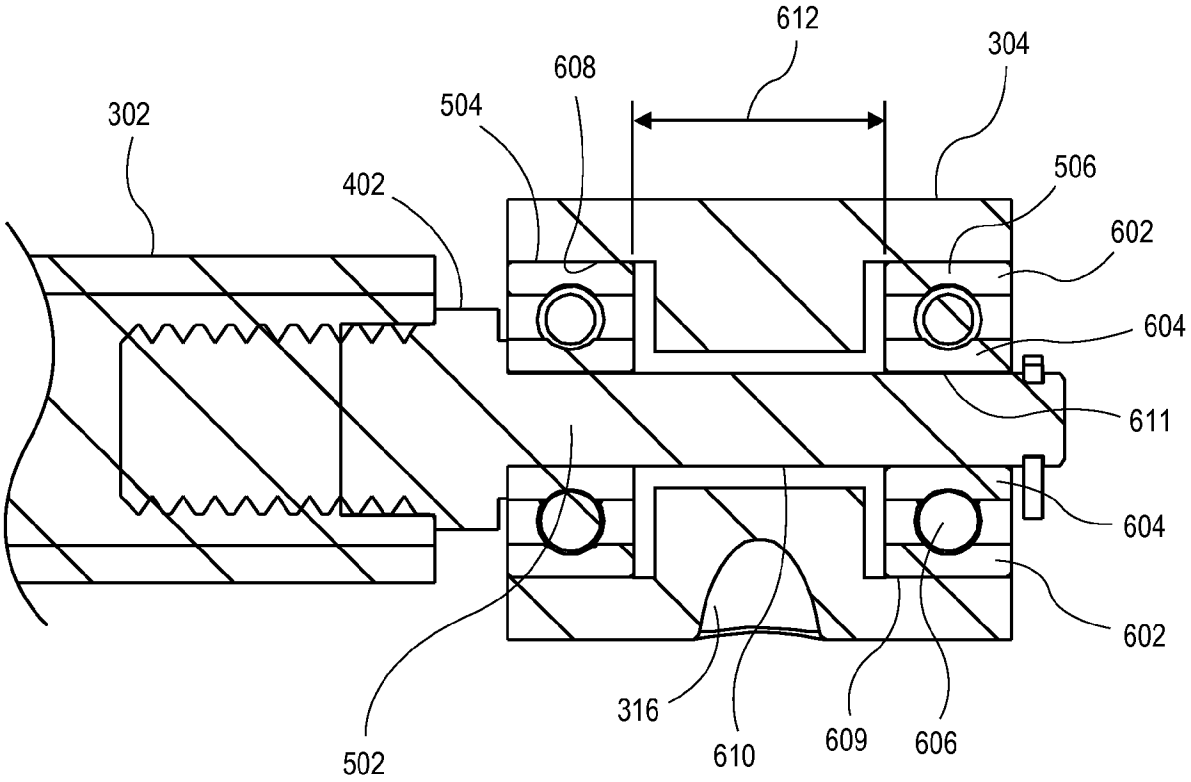
FIG. 6 is a cross-sectional view, taken from Detail A of FIG. 5, of a distal portion of a jump rope handle in accordance with an embodiment.

Referring to FIG. 6, a cross-sectional view of a distal portion of a jump rope handle, taken from Detail A of FIG. 5, is shown in accordance with an embodiment. In an embodiment, a bearing system includes multiple bearings separated along central axis 306. For example, the bearing system may include proximal bearing 504 supporting head 304 near a proximal end and distal bearing 506 supporting head 304 near a distal end. More particularly, a head inner surface 608 may be supported by a bearing outer surface 609 of each bearing, and a shaft outer dimension 610 may support a bearing inner surface 611 of each bearing. Thus, the bearing system may maintain a radial and axial alignment between head 304 and shaft 502, while permitting head 304 and shaft 502 to rotate freely relative to each other.

In an embodiment, head 304 may be directly supported by a bearing positioned on shaft 502. That is, each bearing may directly couple head 304 with shaft 502, while also rotationally decoupling head 304 from 502. More particularly, bearing outer surface 609 and bearing inner surface 608 may be coupled with head 304 and shaft 502, respectively, at locations that are axially aligned with each other. These locations, which may be for example where an inner race of a bearing presses against shaft 502 and an outer race of the bearing presses against head 304, may be radially offset from each other by a thickness of the bearing ring, e.g., a distance between the bearing inner and outer surfaces. Furthermore, in an embodiment, head 304 is directly supported around shaft 502 by multiple bearings that are located distal to grip 302.

In an embodiment, the bearing system includes at least one bearing designed to support radial loading applied to head 304. For example, in an embodiment, each bearing is a rolling bearing having an outer race 602 and an inner race 604 that are rotationally decoupled from each other by one or more intermediate rollers 606. Thus, the outer race 602 may rotate around the inner race 604 with minimal friction and at high speeds, due to rolling of the intermediate rollers 606. Intermediate rollers 606 may be chosen depending on the anticipated speed and loading conditions, but may for example include balls, cylindrical rollers, spherical rollers, tapered rollers, or needle rollers. Thus, the bearing system may support radial loading applied to head 304 by a swinging rope while enabling rapid spinning of head 504 about shaft 502.

In an embodiment, the bearing system may also include bearings that support non-radial loading of head 304. For example, at least one of the bearings may be a thrust bearing designed to support axial loading applied to head 304 by a swinging rope. Thus, although loading on head 304 during use may primarily be transverse loading in a radial direction, the bearing system may be designed to support both transverse and axial loads. In an embodiment, proximal bearing 504 supports most of the axial loading that occurs during use, and therefore, proximal bearing 504 may be a thrust bearing such as a thrust ball bearing, a spherical roller thrust bearing, a tapered roller thrust bearing, or a cylindrical roller thrust bearing.

In addition to supporting alternative loading schemes, bearings in the bearing system may be of different types. For example, one or more of the bearings may be a plain bearing having bearing outer surface 609 coupled with head inner surface 608 and bearing inner surface 611 coupled with shaft 502. Either or both of the bearing surfaces may be glidingly coupled with respective head or shaft surfaces such that the respective head and/or shaft surfaces slide over the plain bearing surface. Furthermore, either of bearing outer surface 609 or bearing inner surface 611 may be fixed relative to a respective head or shaft surface. The plain bearing may be made from, or coated with, a material that exhibits a low coefficient of friction in combination with the respective surfaces, e.g., polytetrafluoroethylene. In addition to plain bearings, the bearing system may also incorporate one or more fluid bearings or magnetic bearings. Thus, the bearing system may include at least two, and in some cases more than two, bearings of a same or different type to support axial and radial loading of head 304.

In an embodiment, a head inner surface 608 may be coupled with outer race 602 of each bearing in the bearing system. For example, each outer race 602 may be pressed into a counterbore in head 304 such that a bearing outer surface 609 forms a press fit with head inner surface 608 to securely fasten outer race 602 with head 304. Similarly, each inner race 604 may be fastened with a shaft outer dimension 610. For example, shaft 502 may be pressed through each inner race 604 such that a bearing inner surface 611 forms a press fit with shaft outer dimension 610 to securely fasten inner race 604 to shaft 502.

Given that proximal bearing 504 and distal bearing 506 may rotationally support head 304 at either end relative to shaft 502, in an embodiment, head 304 is rotationally decoupled from shaft 502 and is supported across a span 612 between proximal bearing 504 and distal bearing 506. More particularly, head 304 may only be in contact with the outer races 602 of each bearing in handle 300. Accordingly, in an embodiment, any loading applied to head 304 by a swinging rope will be resisted solely by the bearings in the bearing system. A magnitude and direction of loading on each of the bearings may depend on the location at which the rope applies a load to head 304.

In an embodiment, rope retainer slot 316 and/or rope landing 315 may be longitudinally, e.g., axially, between proximal bearing 504 and distal bearing 506 such that the rope applies a load to head 304 within span 612. In such case, because the net torque on the bearing system may usually be zero, loading applied to proximal bearing 504 and distal bearing 506 will be in a same direction, i.e., in a direction opposite to the transverse loading from the rope. The magnitude of loading seen by each bearing will depend on the distance each bearing is set away from the point at which rope applies a transverse load. For example, when rope landing 315, and therefore transverse loading, is axially centered within span 612, reaction forces on proximal bearing 504 and distal bearing 506 will be substantially equal to each other and the respective reaction forces will be approximately half of the transverse load magnitude. That is, the bearings in the bearing system will share the transverse loading equally. Alternatively, as the rope landing 315 moves closer to one of the bearings, the other bearing will share a disproportionately higher amount of the transverse loading, i.e., one bearing will see a higher reaction force than the other. Thus, a location of rope landing 315, rope retainer slot 316, and rope guide 406 may be altered to change the location of transverse loading from rope, and to tune load sharing by the bearings. More particularly, in an embodiment, rope path 314 may pass through head 304 at a location axially between the bearings to evenly distribute the transverse load amongst the bearings such that maximum loading of any one bearing may be reduced, and therefore, the life of all bearings in the bearing system may be extended.

Figure 2:
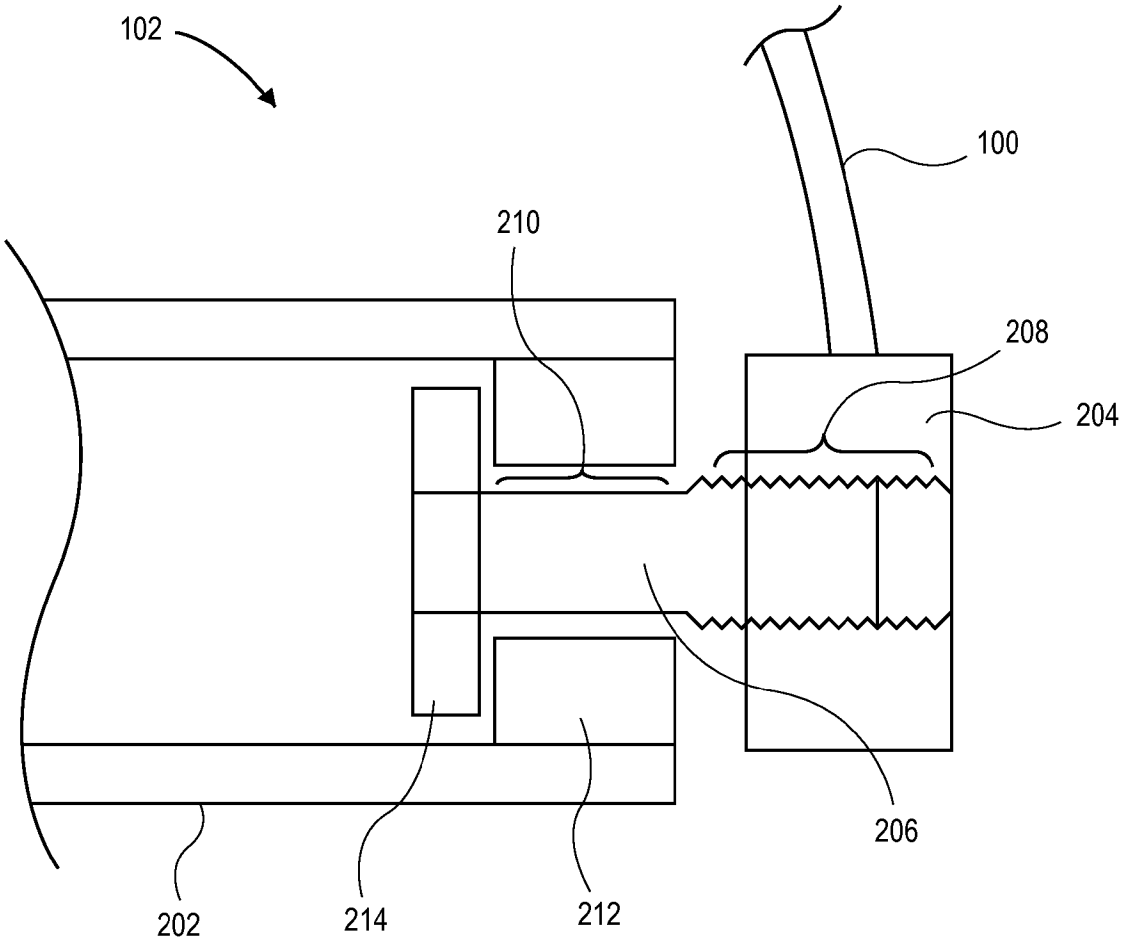
FIG. 2 is a cross-sectional view of a portion of a jump rope handle.
Figure 7:
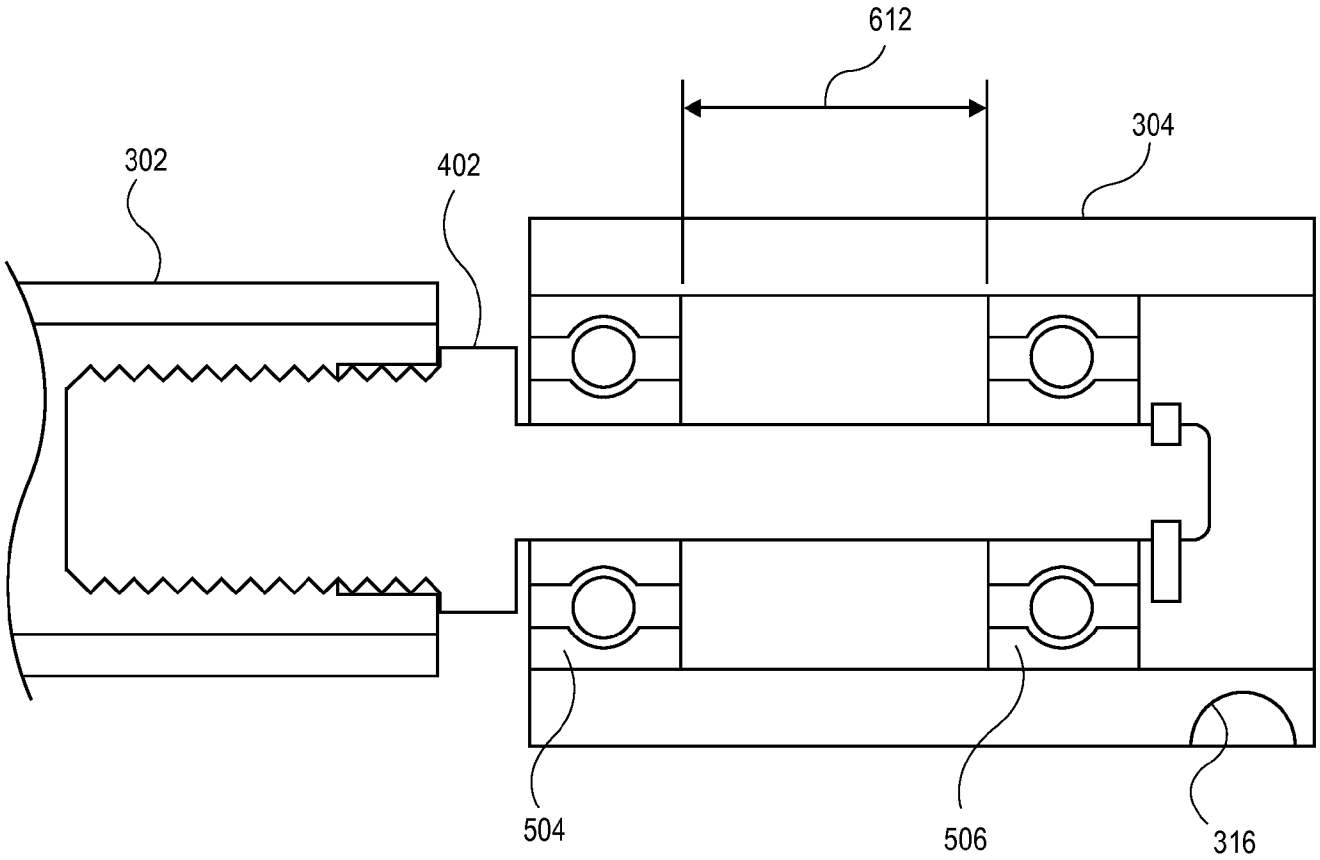
FIG. 7 is a cross-sectional view of an alternative embodiment of a distal portion of a jump rope handle in accordance with an embodiment.

Referring to FIG. 7, a cross-sectional view of an alternative embodiment of a distal portion of a jump rope handle is shown in accordance with an embodiment. In an embodiment, transverse loading applied by a rope may not be equally shared by the bearings in the bearing system. For example, rope retainer slot 316 and/or rope landing 315 may be located in head 304 distal to distal bearing 506. That is, rope landing 315, and thus the location at which transverse loading from the rope is applied, may be located outside of span 612, e.g., distal to distal bearing 506 or proximal to proximal bearing 504. As a result, rather than exhibiting a loading profile of a simply supported beam between the bearings, head 304 may exhibit a loading profile of a supported beam with one end cantilevered beyond a bearing. Accordingly, while net torque on the bearing system may usually be zero, summing moments about the bearings reveals that reaction forces on distal bearing 506 will be opposite to reaction forces on proximal bearing 504. More particularly, distal bearing 506 may support a reaction force opposite to the transverse loading from the rope, and proximal bearing 504 may support a reaction force in the same direction as the transverse loading from the rope. Furthermore, distal bearing 506 may have a higher reaction force applied to it than the reaction force applied to proximal bearing 504. Thus, in an embodiment, locating rope retainer slot 316 and/or rope landing 315 outside of span 612, e.g., distal to distal bearing 506 or proximal to proximal bearing 504, may create an asymmetry in the bearing system, both in loading magnitude and direction on respective bearings. Nonetheless, the maximum loading applied to either bearing may be less than the loading experienced by bearings in existing jump rope handles, such as the loading described with respect to FIG. 2, above. Furthermore, a speed rope handle configured as shown in FIG. 7 may allow for a reduction in cross-sectional profile, since the rope guide 406 may pass more closely to central axis 306, i.e., may be moved closer to central axis 306, potentially resulting in a more compact handle form factor.

Figure 8A:
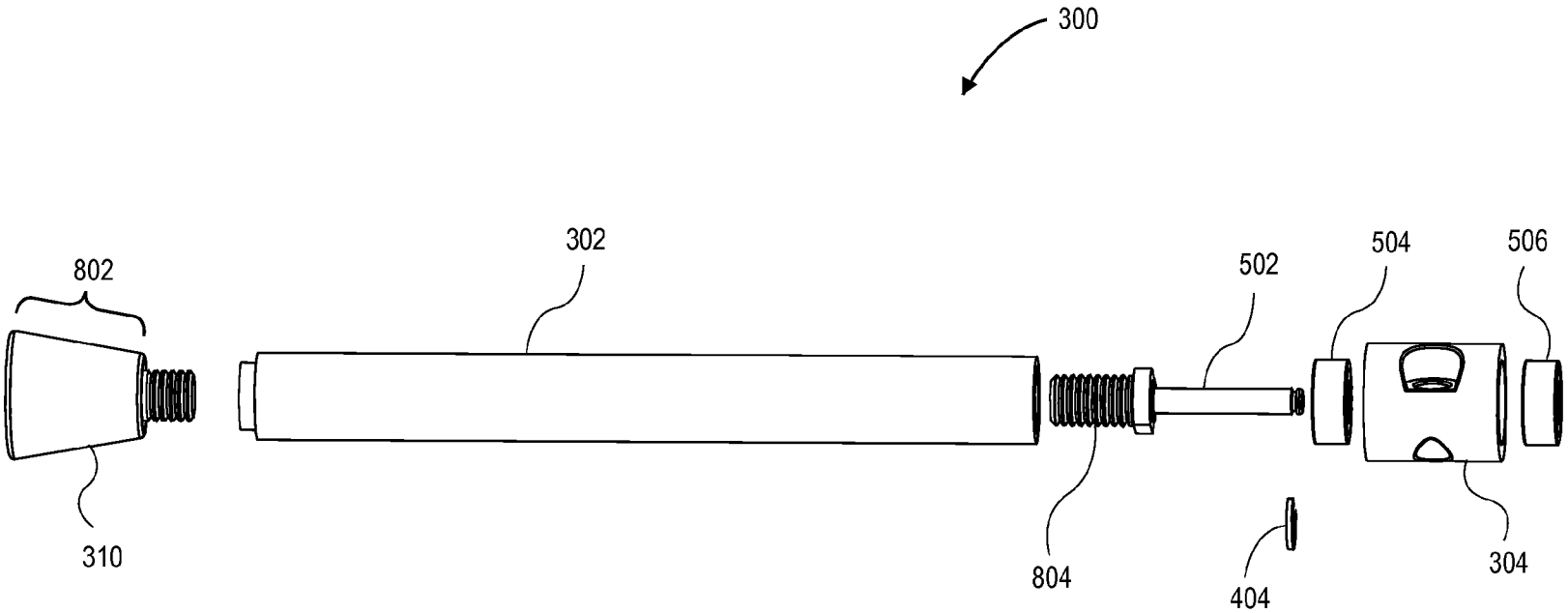
FIGS. 8A-8C are exploded views of a jump rope handle in accordance with an embodiment.

Referring to FIG. 8A, an exploded view of a jump rope handle is shown in accordance with an embodiment. Grip 302 may include features to allow a jumper to securely hold handle 300 during high intensity jumping. For example, an outer surface of grip 302 may be shaped to facilitate handling, e.g., may be cylindrical or contoured to conform to a hand grip. The outer surface may also be modified to improve handling, such as by incorporating knurled or roughened surfaces. Furthermore, grip may be overmolded, coated, or covered with materials that are easy to grip, such as foam, rubber, etc. To further improve handling, handle 300 may include foot 310 to prevent handle 300 from being pulled from a jumper's hand by the momentum of a swinging rope. Foot 310 may include a tapered region 802 extending proximally from grip 302, such that a proximal end of foot 310 has a greater profile than a distal end of foot 310. That is, foot 310 may have a frustoconical outer surface that tapers inward along tapered region 802 in a distal direction. The distal end of tapered region 802 may include a cross-sectional profile that matches that of a proximal end of grip 302. Thus, foot 310 may transition smoothly from tapered region 802 to grip 302.

In an assembled state, shaft 502 and foot 310 may be integral to grip 302. For example, in an embodiment, shaft 502 may include a threaded base 804 near a proximal region. The threaded base 804 may be a male fastener that can engage a female threaded portion in grip 302. Similarly, foot 310 may include a threaded portion extending distally from a distal end of tapered region 802. The threaded portion may be a male fastener to mate with a corresponding female threaded portion in grip 302. Alternatively, the threads of shaft 502 and foot 310 may be reversed with respect to grip 302. For example, grip 302 may include male threaded portions that engage respective female threaded portions of shaft 502 or foot 310. Accordingly, after threading shaft 502, foot 310, and grip 302 together, the parts may be securely fastened to make shaft 502, foot 310, and grip 302 integral to each other for all intents and purposes during use.

Figure 8B:
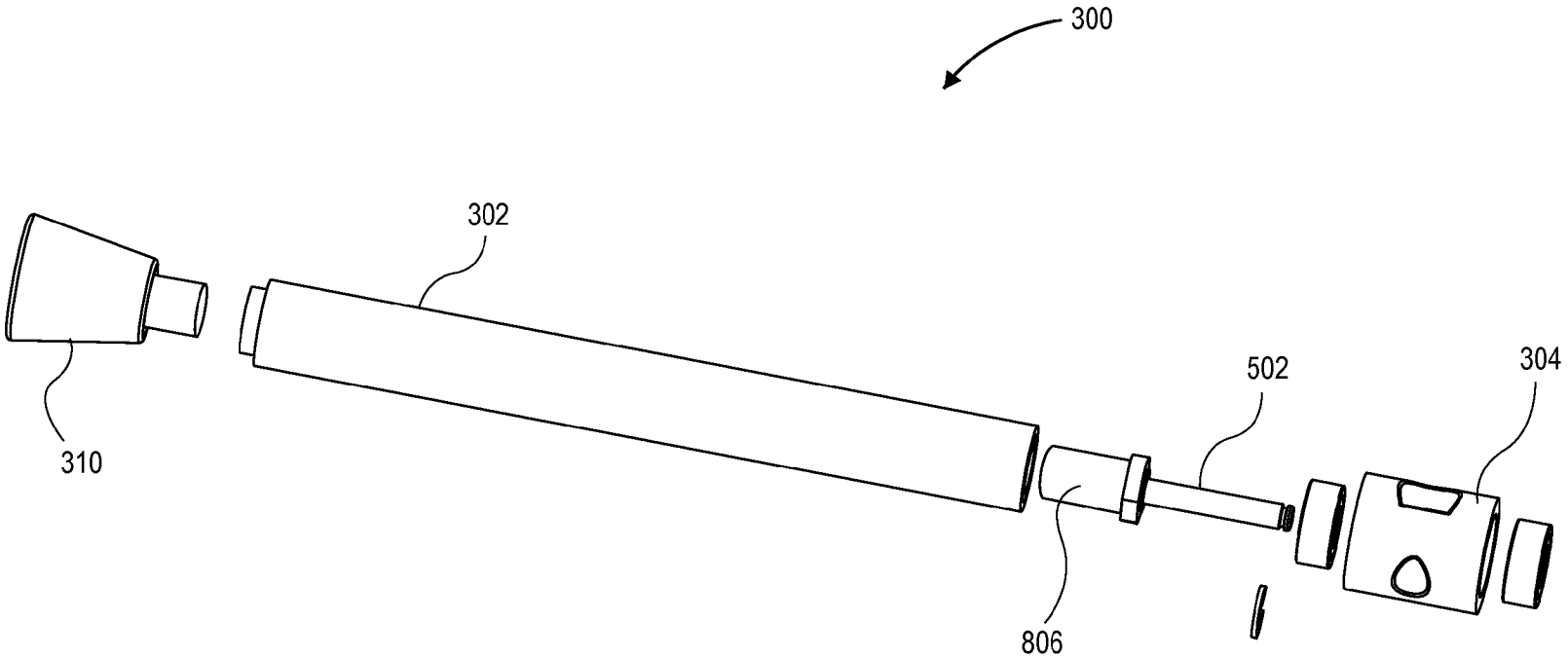

Referring to FIG. 8B, an exploded view of a jump rope handle is shown in accordance with an embodiment. Alternative modes of fastening handle parts together may be used. That is, components such as shaft 502 and foot 310 may be fixed to grip 302 in numerous other manners. For example, shaft 502 may include a boss 806 having an outer diameter sized to produce a press fit with a counterbore or hole formed in grip 302. Similarly, foot 310 may also include a boss sized to be press fit inside of a counterbore or hole formed in grip 302. Thus, shaft 502, foot 310, and grip 302 may be pressed together during assembly to make the parts integral to each other for all intents and purposes during use.

Figure 8C:
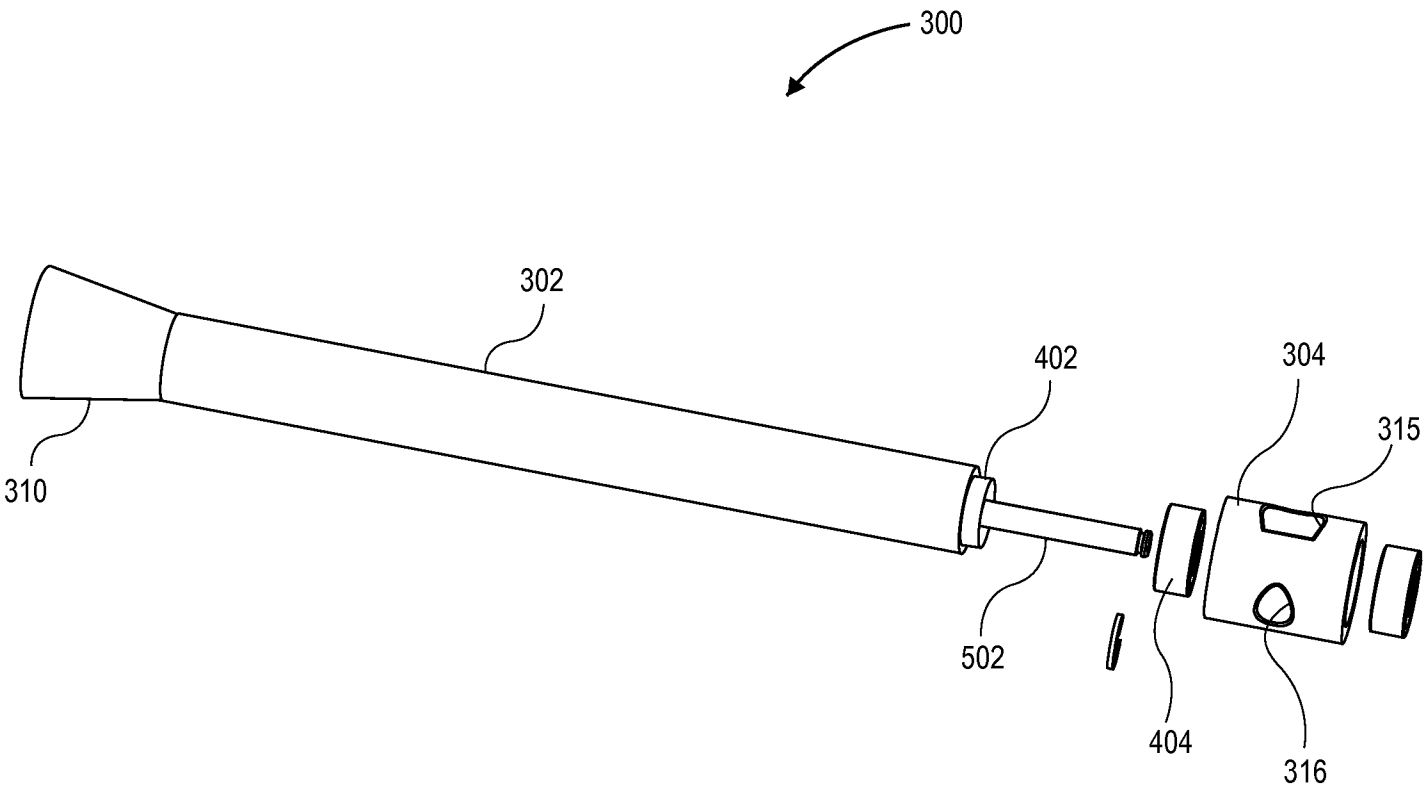

Referring to FIG. 8C, an exploded view of a jump rope handle is shown in accordance with an embodiment. In an embodiment, a handle 300 may include grip 302 integrally formed with shaft 502 and foot 310. That is, grip 302, shaft 502, and foot 310 may be formed from a single piece of material. For example, a single piece of material, e.g., bar stock, may be machined to form a cylindrical shaft 502 region, a cylindrical grip region, and a tapered foot 310 region. Furthermore, shoulder 402 may be formed in the integral grip 302 to act as a transition region between shaft 502 and grip 302 and to maintain appropriate spacing between head 304 and grip 302. That is, shoulder 402 may press against proximal bearing 504, e.g., against an inner race 604 of the bearing, without pressing against head 304 or allowing head 304 to press against grip 302. Accordingly, shoulder 402 may reduce friction between head 304 and grip 302. In alternative embodiments, shoulder 402 may not be integrally formed with grip 302, but may be a separately formed component. For example, shoulder 402 may be a collar concentrically located about shaft 502 or, as shown in FIG. 8A, a shoulder region between threaded base 804 and shaft 502.

Figure 9:
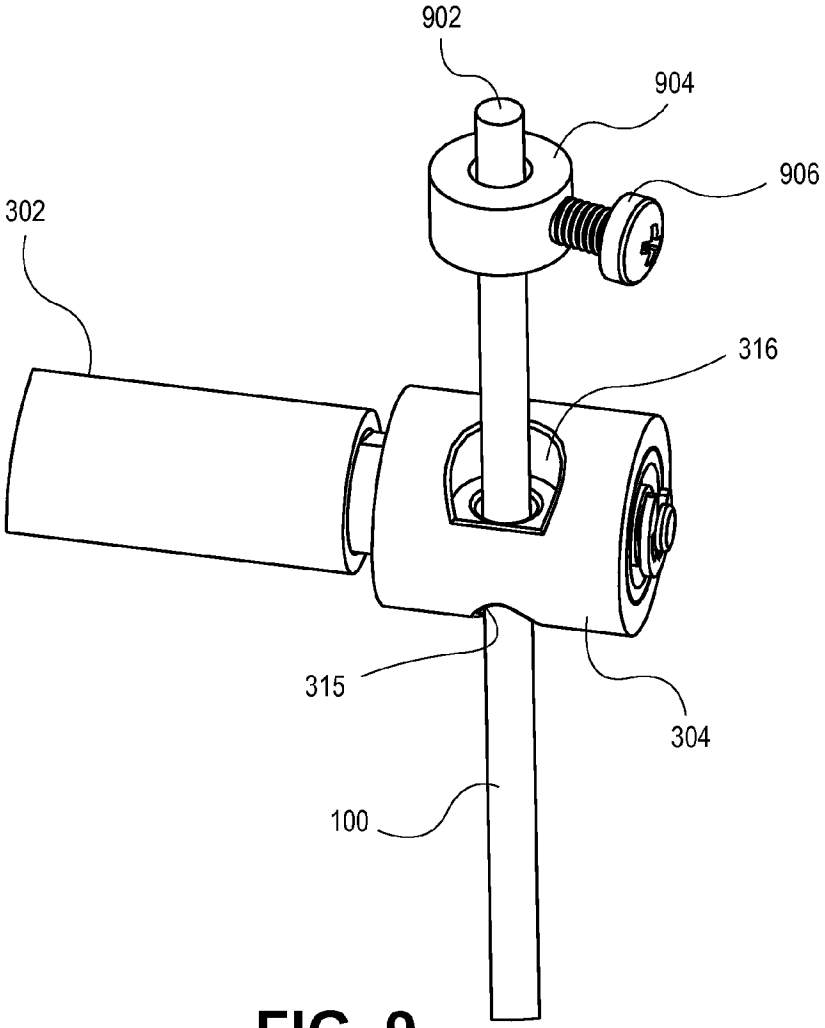
FIG. 9 is a perspective view of a distal portion of a jump rope handle in accordance with an embodiment.

Referring to FIG. 9, a perspective view of a distal portion of a jump rope handle is shown in accordance with an embodiment. As described above, a rope 100 may be passed through rope guide 406 between rope landing 315 and rope retainer slot 316 such that a rope end 902 is on an opposite side of rope landing 315 from a portion of rope that swings around the jumper. Rope may be secured within head 304 using various rope fasteners. For example, in a simple embodiment, a knot may be tied near rope end 902 such that the knot profile is too large to pass through rope guide 406 and therefore rope is secured within head 304. In an embodiment, a collar 904 may be passed over rope end 902 and a set screw 906 may be threaded radially through collar 904 to pinch rope between an inner surface of collar 904 and a tip of set screw 906. Thus, collar 904 may be fastened to rope near rope end 902. Since collar 904 may have a profile too large to pass through rope guide 406, collar 904 may therefore secure rope within head 304.

In the foregoing specification, the invention has been described with reference to specific exemplary embodiments thereof. It will be evident that various modifications may be made thereto without departing from the broader spirit and scope of the invention as set forth in the following claims. The specification and drawings are, accordingly, to be regarded in an illustrative sense rather than a restrictive sense.

What is claimed is:

1. A jump rope handle, comprising:

a grip having a shaft;

a head rotationally coupled with the grip by a plurality of bearings, wherein each of the plurality of bearings includes a bearing inner surface adjacent to the shaft and a bearing outer surface adjacent to the head, and wherein the head includes a rope landing intermediate to the plurality of bearings.

2. The jump rope handle of claim 1, wherein the rope landing is axially centered between the plurality of bearings.

3. The jump rope handle of claim 1, wherein the plurality of bearings include a distal bearing and a proximal bearing, and wherein the distal bearing and the proximal bearing are each selected from a group consisting of a plain bearing, a rolling bearing, a fluid bearing, and a magnetic bearing.

4. The jump rope handle of claim 3, wherein at least one of the distal bearing or the proximal bearing includes a rolling bearing having an inner race coupled with the shaft at the bearing inner surface and an outer race coupled with the head at the bearing outer surface.

5. The jump rope handle of claim 4, wherein the rolling bearing includes a thrust bearing.

6. The jump rope handle of claim 5, wherein the proximal bearing includes the thrust bearing.

7. The jump rope handle of claim 3, wherein at least one of the distal bearing or the proximal bearing includes a plain bearing having the bearing outer surface and the bearing inner surface.

8. The jump rope handle of claim 1, wherein the shaft is integral with the grip.

9. The jump rope handle of claim 8, wherein the shaft includes a threaded base configured to be threaded into the grip.

10. The jump rope handle of claim 8, wherein the shaft includes a boss configured to be pressed into the grip.

11. The jump rope handle of claim 1, wherein the grip includes a foot having a foot outer surface tapering inward in a distal direction.

12. A speed rope, comprising:

a handle including a grip having a shaft, a head rotationally coupled with the grip by a plurality of bearings, and a rope landing, wherein each of the plurality of bearings include a bearing inner surface adjacent to the shaft and a bearing outer surface adjacent to the head, and wherein the rope landing is intermediate to the plurality of bearings;

a rope having a first end opposite of the rope landing from a second end; and a rope retainer coupled with the rope opposite of the rope landing from the second end and configured to secure the rope in the head.

13. The speed rope of claim 12, wherein the rope landing is axially centered between the plurality of bearings.

14. The speed rope of claim 12, wherein the plurality of bearings include a distal bearing and a proximal bearing, and wherein the distal bearing and the proximal bearing are selected from a group consisting of a plain bearing, a rolling bearing, a fluid bearing, and a magnetic bearing.

15. The speed rope of claim 14, wherein at least one of the distal bearing or the proximal bearing includes a rolling bearing having an inner race coupled with the shaft at the bearing inner surface and an outer race coupled with the head at the bearing outer surface.

* * * * *